US006927729B2

(12) United States Patent
Legay

(10) Patent No.: US 6,927,729 B2
(45) Date of Patent: Aug. 9, 2005

(54) MULTISOURCE ANTENNA, IN PARTICULAR FOR SYSTEMS WITH A REFLECTOR

(75) Inventor: Hervé Legay, Plaisance du Touch (FR)

(73) Assignee: Alcatel, Paris (FR)

( * ) Notice: Subject to any disclaimer, the term of this patent is extended or adjusted under 35 U.S.C. 154(b) by 79 days.

(21) Appl. No.: 10/627,772

(22) Filed: Jul. 28, 2003

(65) Prior Publication Data

US 2004/0021607 A1 Feb. 5, 2004

(30) Foreign Application Priority Data

Jul. 31, 2002 (FR) ..... 02 09740

(51) Int. Cl.[7] ..... H01Q 1/38
(52) U.S. Cl. ..... 343/700 MS; 343/909
(58) Field of Search ..... 343/700 MS, 767, 343/829, 846, 909

(56) References Cited

U.S. PATENT DOCUMENTS 4,021,812 A 5/1977 Schell et al.
5,160,936 A * 11/1992 Braun et al. ..... 343/725
6,690,327 B2 * 2/2004 McKinzie et al. ... 343/700 MS

FOREIGN PATENT DOCUMENTS

GB 2 337 860 A 12/1999
WO WO 01/37373 A1 5/2001

* cited by examiner

*Primary Examiner*—Shih-Chao Chen
(74) *Attorney, Agent, or Firm*—Sughrue Mion, PLLC

(57) ABSTRACT

A multisource antenna includes at least two excitation sources and for spatially channeling energy picked up/radiated by the excitation sources and providing for frequency decoupling between the bands respectively corresponding to the waves received/transmitted by the sources. The sources are arranged on a ground plane to interleave radiating apertures at the level of the spatial and frequency selective arrangements.

15 Claims, 8 Drawing Sheets

FIG_1 PRIOR ART
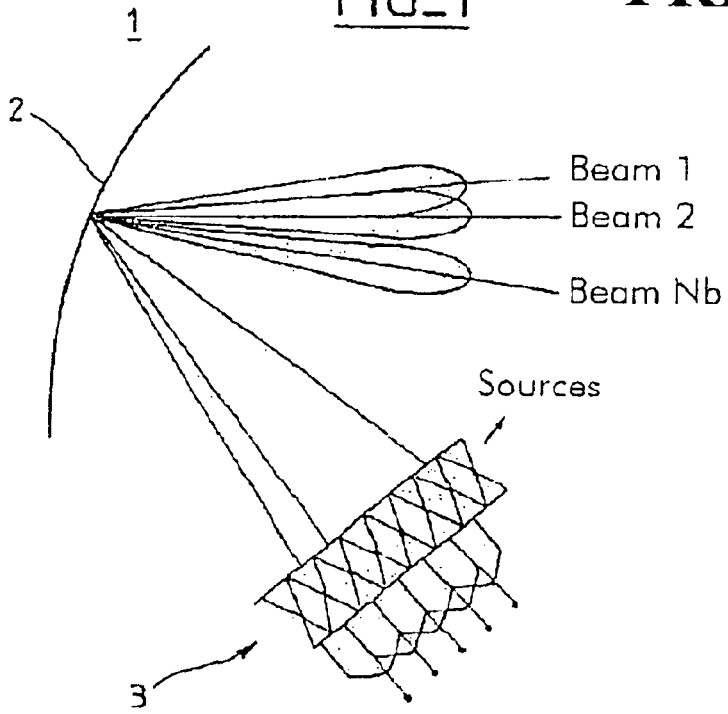
FIG_2a
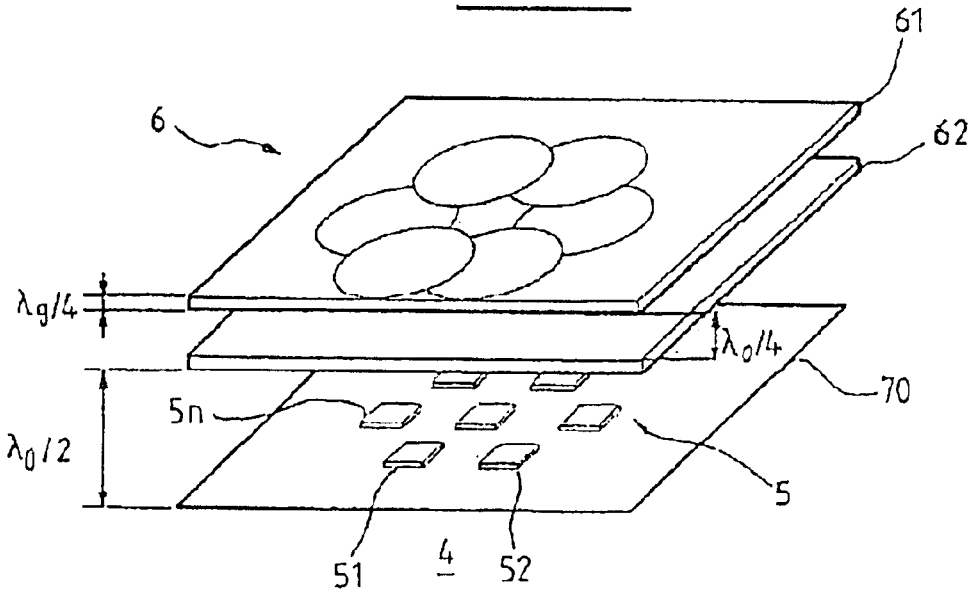

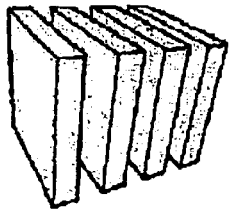
FIG_2b
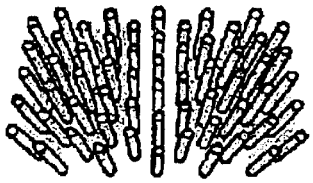
FIG_2c
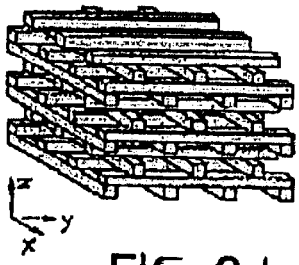
FIG_2d
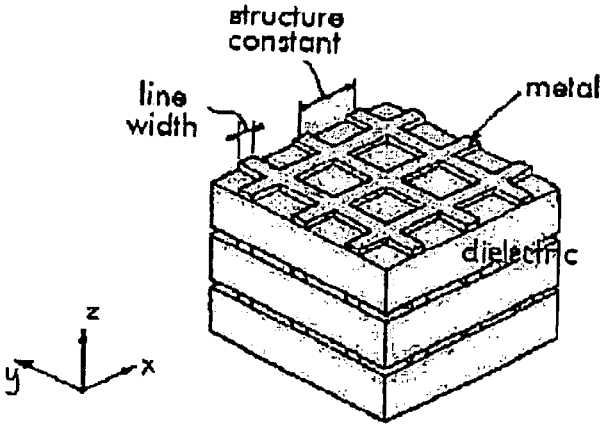
FIG_7b
FIG_11
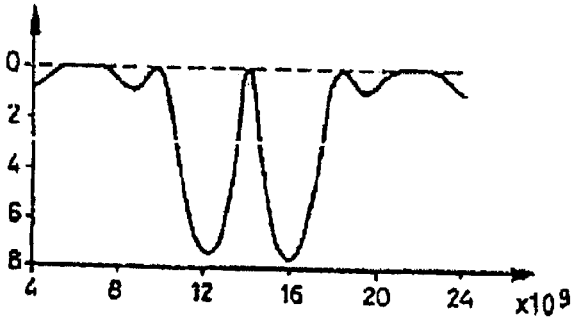

MULTISOURCE ANTENNA, IN PARTICULAR FOR SYSTEMS WITH A REFLECTOR

CROSS-REFERENCE TO RELATED APPLICATIONS

This application is based on French Patent Application No. 02 09 740 filed Jul. 31, 2002, the disclosure of which is hereby incorporated by reference thereto in its entirety, and the priority of which is hereby claimed under 35 U.S.C. §119.

BACKGROUND OF THE INVENTION

1. Field of the Invention

The present invention relates to telecommunications. It relates more particularly to a multisource telecommunication antenna. The multisource antenna can be used in a system with a reflector.

2. Description of the Prior Art

Focusing systems are routinely used in space because their performance enables them to cover a plurality of terrestrial areas. However, it is not possible to produce a regular grid of contiguous coverages, which are also known as spots, with a reflector antenna associated with an array of multiple passive sources, each defining one spot access. The sources of this kind of passive focal array must meet two antagonistic constraints:

the maximum size of the sources is limited by the mesh of the focal array, and depends directly on the spacing between the spots, and that maximum size is insufficient; the reflector being badly illuminated, the illumination yield is affected by very high spillover losses and does not meet the required specifications in terms of the required antenna gain.

It follows that a regular coverage of spots is still critical and is achieved either with a system of four reflector antennas coupled to multiple passive sources (which is the standard solution adapted for coverage in the Ka band) or with a single focal array fed reflector (FAFR) active antenna whose beam forming network (BFN) is complex.

To illuminate correctly a system 1 with a reflector 2 and a multisource array 3, it is necessary to interleave the primary sources, as shown in FIG. 1. A primary source is produced by combining a plurality of smaller sources (FAFR and associated BFN). Amplifiers must be placed between the sources and the BFN. This solution is obviously complex and costly.

Moreover, in addition to the objective of providing a multisource antenna for multispot coverage, the present invention aims to propose a compact multiband directional antenna that overcomes the overall size problems of the prior art represented by a reflector antenna with dual-band source and a system with two plane antennas.

An object of the present invention is therefore to solve the problems stated above.

SUMMARY OF THE INVENTION

The invention therefore consists in a multisource antenna including at least two excitation sources and spatial and frequency selective means for spatially channeling energy picked up/radiated by the excitation sources and providing for frequency decoupling between the bands respectively corresponding to the waves received/transmitted by the sources, which are arranged on a ground plane to interleave radiating apertures at the level of the spatial and frequency selective means.

Accordingly, thanks to the invention, the energy radiated by each of the excitation sources is channeled over a larger apparent surface area, whilst avoiding coupling between sources. Furthermore, the equivalent source at the level of the selectivity means is sufficiently directional not to generate spillover losses, since interleaving reduces losses by virtue of the intersection of two spots.

In one embodiment, the spatial and frequency selective means comprise a forbidden photonic band array.

In one embodiment, the forbidden photonic band array comprises an arrangement of dielectric plates with a one-dimensional period (1D arrangement).

In one embodiment, the forbidden photonic band array comprises an arrangement of dielectric rods with a two-dimensional period (2D arrangement).

In one embodiment, the forbidden photonic band array comprises an arrangement of dielectric rods with a three-dimensional period (3D arrangement, woodpile type).

In one embodiment, the forbidden photonic band array comprises a periodic arrangement of metal patterns.

In one embodiment, the forbidden photonic band array comprises a periodic arrangement of slots in said ground plane.

In one embodiment, the forbidden photonic band array comprises an arrangement of metal wires.

In one embodiment, the excitation sources form a passive focal array, the interleaving of the radiating apertures associated with each source of the passive focal array generating an energy channel radiated over an enlarged apparent surface area at the level of the forbidden photonic band array.

In one embodiment, the excitation sources operate in different frequency bands and with the same radiating aperture.

In one embodiment, the excitation sources operate in different frequency bands and with the same radiating aperture and said forbidden photonic band array comprises at least two metal plates with resonating patterns resonating at their natural frequency and transparent at the other resonant frequency.

In one embodiment, the forbidden photonic band array comprises a periodic arrangement of metal wires, some of which wires are locally and periodically removed to form a second operating band independent of the first.

In one embodiment, one metal plate forms a reflective surface at a highest operating frequency and is transparent at a lowest operating frequency, being at a distance of $\lambda fh/2$ from the ground plane, and a second metal plate forms a surface reflective at the lowest frequency and transparent at the highest frequency, being at a distance of $\lambda fh/2$ from the ground plane.

In one embodiment, the forbidden photonic band array comprises a periodic arrangement of dielectric plates, the thickness of one of which is modified relative to the others, this disruption of the period producing a second operating band independent of the first.

In one embodiment, at least one source operates in a receive frequency band and another source operates in a transmit frequency band.

In one embodiment, the source is adapted to operate in a system with a reflector.

To explain the invention further, embodiments of the invention are described next with reference to the accompanying drawings and by way of examples that do not limit the scope of the invention.

BRIEF DESCRIPTION OF THE DRAWINGS

FIG. 1, already described, shows a reflector illuminated by a prior art multisource array.

FIG. 2*a* shows a first embodiment of a multisource antenna according to the invention comprising an FPB array with an arrangement of dielectric plates with a one-dimensional period and FIGS. 2*b*, 2*c* and 2*d* respectively show dielectric electromagnetic crystals with a one-dimensional, two-dimensional or three-dimensional period.

FIG. 7*a* shows another embodiment of an antenna according to the invention and FIG. 7*b* shows in more detail the arrangement of metal wires used therein.

FIG. 11 shows the spectrum obtained upon inserting a selective pass-band into a forbidden band.

DETAILED DESCRIPTION OF THE PREFERRED EMBODIMENTS

Figure 3:
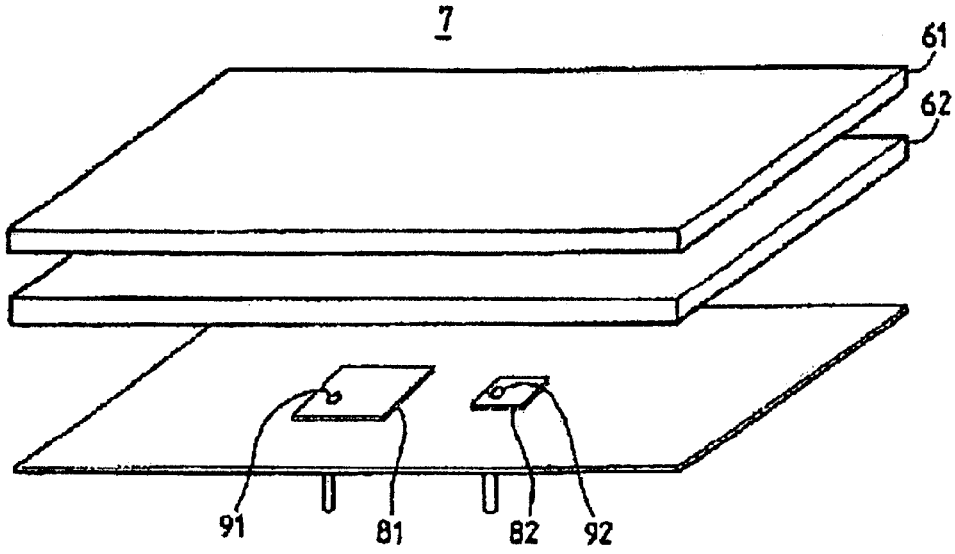
FIG. 3 shows a second embodiment of a multisource antenna according to the invention.

In the present patent application, items with similar functions are identified by the same reference numbers.

Forbidden photonic band (FPB) antennas using the properties of photonic crystals have recently been of great interest to the scientific community.

The aim of the present invention is to apply the potential of these antennas to innovative antenna concepts for satellite telecommunication systems (antennas onboard satellite type spacecraft or terrestrial antennas on the ground).

The fundamental property of an FPB array is its spatial and frequency selectivity. Thus different applications can be envisaged for FPB array antennas:

a first application exploits the capacity of the FPB array to channel in a previously chosen direction the energy radiated from a single exciter member (for example a patch), whilst enlarging the radiating surface; this yields an antenna that is much more directional than the exciter member;

a second application is to the production of a frequency and spatial filter with suppression of surface waves, attenuation of array lobes, increased decoupling between radiating elements, etc.

An FPB array can be produced by a periodic arrangement of metal or dielectric patterns. Of course, there are innumerable ways to produce an FPB array. For conciseness, the present application describes in detail only arrays with dielectric or metal patterns.

Thus an FPB array can consist of a regular arrangement of dielectric plates having a permittivity $\in_{r1}$ and a thickness $\lambda/4$ sqrt($\in_{r1}$) spaced by a medium having a lower permittivity $\in_{r2}$ and a thickness $\lambda/4$ sqrt($\in_{r2}$). It can equally be produced by an arrangement of very high permittivity dielectric rods spaced by $\lambda/4$. This kind of array of dielectric plates is disclosed in U.S. Pat. No. 6,549,172, for example.

If an FPB array is used to increase the directionality of a source, and in particular to interleave the radiating apertures of a plurality of sources, it is necessary for the following additional conditions to apply:

as explained above, the first dielectric layer (or metal layer in the context of an embodiment with metal patterns described below) is distant from the ground plane by half an electric wavelength, and the structure is excited by a probe, a patch near the ground plane, or a radiating opening in the ground plane.

In the following description, the first example of an FPB array is an array with dielectric layers.

FIG. 2 shows a multisource antenna 4. The antenna includes a focal array 5 and an FPB array consisting of an arrangement of dielectric plates 61, 62 placed on top of a ground plane 70 on which are etched excitation probes 51, 52, . . . , 5*n* forming the array 5.

This periodic arrangement of dielectric plates defines a resonant cavity. The wave emitted by the excitation probe is then distributed over a large radiating surface area. The magnitude of this surface area depends on the reflectivity of the dielectric layers (or metal layers in the case of metal grids).

It will be noted that the FIG. 2*a* FPB network is an illustration of a one-dimensional array of dielectric plates.

FIGS. 2*b*, 2*c* and 2*d* respectively show dielectric electromagnetic crystals with a one-dimensional, two-dimensional and three-dimensional period.

Figure 7A:
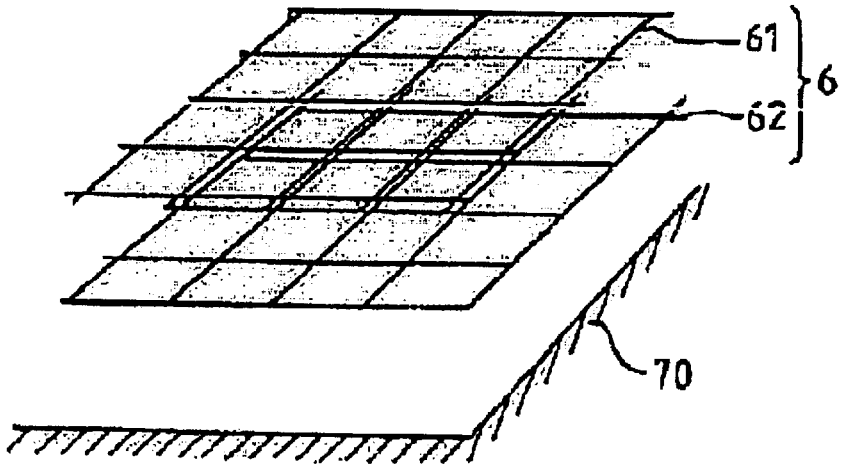

A number of families of partly reflecting materials are mentioned in the present application:

dielectric multilayer materials, several types of arrangements of which are shown in FIGS. 2*a* to 2*d*, metal wire materials, shown in FIGS. 7*a* and 7*b*, and materials consisting of an array of resonant metallic patterns.

When they are perfectly periodic, these materials are known as electromagnetic crystals. Their response to an incident electromagnetic wave varies from total transmission in the conduction bands to total reflection in the forbidden bands.

In FIG. 2*a*, the array 6 allows interleaving of the radiating apertures associated with each source of the passive focal array. It is a question of channeling the radiated energy over an apparent surface area larger than the excitation sources, whilst preventing excessively high coupling between them. Thus the sources of the passive focal array become more directional than the surface that they occupy in the lower array 5 and spillover losses are reduced.

The coupling is minimized by using frequency selective sources, which can be microstrip patches, dielectric resonators, or non-resonant slots, connected to frequency selective filters.

FIG. 3 shows a second embodiment of a multisource antenna 7 according to the invention. In this embodiment, two patches 81, 82 are excited by two excitation probes 91, 92 in two modes. The two modes can be a fundamental mode and a harmonic, for example.

The antenna 7 is therefore capable of producing a plurality of directional sources, operating in a plurality of frequency bands, in the same radiating aperture. This achieves a very significant saving in space.

The arrangement of the dielectric layers 61, 62 (or metal layers in the case of metal patterns) can be determined to generate a plurality of distinct resonances in the FPB material. Specific arrangements of the dielectric layers 61, 62 (or metal layers in the case of metal patterns) can yield operating bands of the FPB material matched to the ratio specific to the application, and no longer regularly spaced.

Multiband FPB arrays can be produced using metal FPB arrays with resonant patterns. It is then a question of optimizing two FPB arrays at each operating frequency. The layers resonate at their natural frequency and are transparent at the other resonant frequency. This principle is similar to that of frequency selective surfaces. The reflecting layers can then be interleaved to conform to rules for the distances between the layers operating at the same frequency ($\lambda/4$) and the distance between the ground plane and the lower metal layer associated with each operating frequency ($\lambda/2$).

Figure 4:
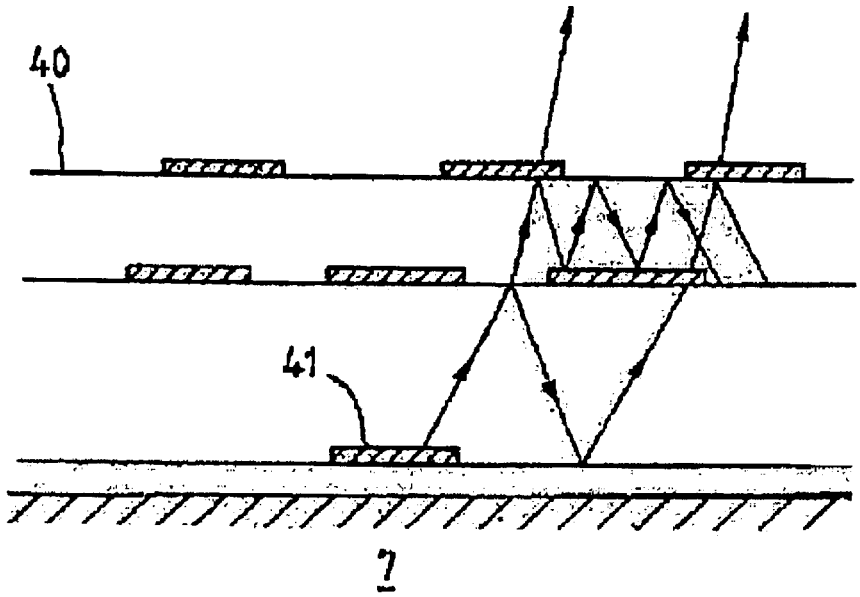
FIG. 4 shows another embodiment of a multisource antenna according to the invention.

FIG. 4 shows an FPB array of this kind taking the form of metal patterns. For example, it can consist of metal wires running in the same direction, spaced by $\lambda/4$, or a grid consisting of two orthogonal arrays of metal wires. This type of FPB array is described in U.S. Pat. No. 6,061,027, for example, FIG. 1 of which shows an embodiment of an FPB array whose reflective surface is made up of metal patterns. In this particular instance, these are circular patches or rings. Crosses, tripoles, etc. can also be envisaged.

In this latter embodiment, the reflective structure consists only of an interface. There can nevertheless be several interfaces 40, as in FIG. 4. In this case, the metal interfaces must be $\lambda/4$ apart. What is essential is to have the reflective structure at a distance of $\lambda/2$ from the ground plane.

It will be noted that the excitation represented here by a patch 41 can also be achieved by a slot in the ground plane, by a dielectric resonator, etc.

Figure 5:
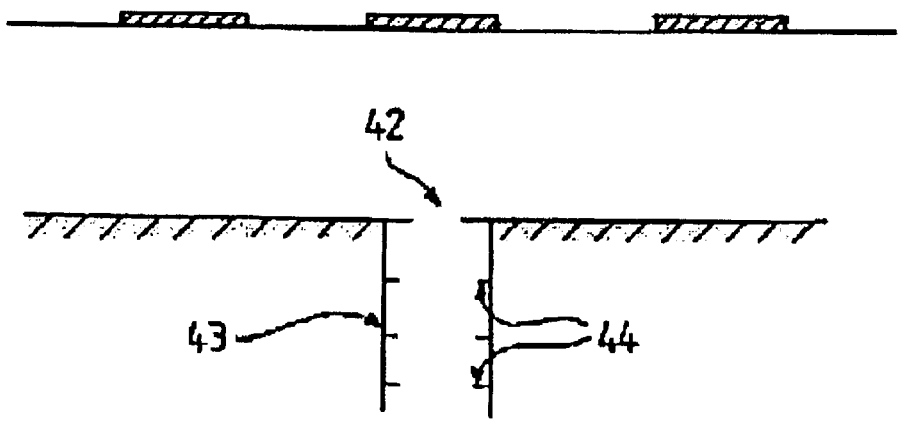
FIG. 5 shows one embodiment of excitation sources according to the invention.

FIG. 5 shows excitation by a slot 42. The benefit of providing this kind of slot is to enable energization via a guide 43 and the filtering necessary for correct operation of the antenna using a guide technology filter. Irises 44 are installed in the guide to enable adaptation thereof. Such irises are described in the patent referred to above, for example.

Figure 6:
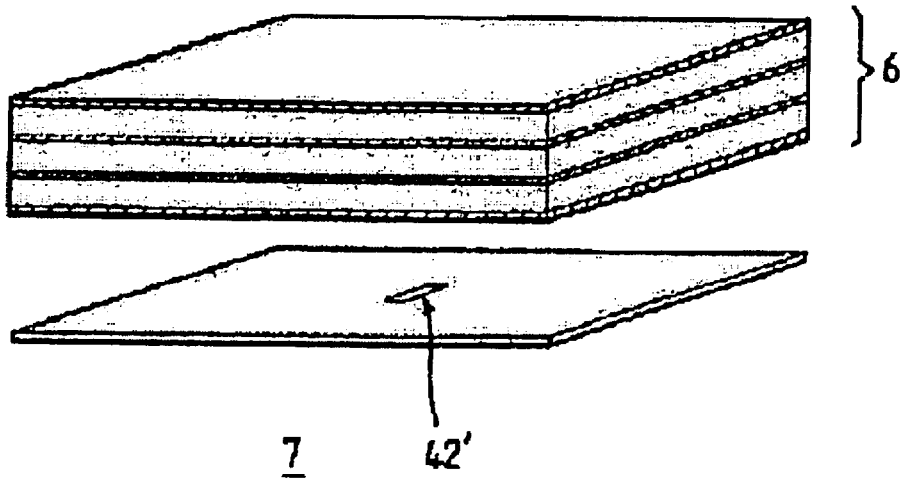
FIG. 6 shows a further embodiment of a multisource antenna according to the invention.

FIG. 6 shows an antenna 7 with an array 6 of dielectric layers energized via a slot 42'. What is essential for this slot, to limit coupling between adjacent slots, is that it not be resonant.

FIG. 7 shows one embodiment of an antenna according to the invention. The FPB array 6 used is of the metal type and its layers 61, 62 are not resonant. They consist of metal wires or tracks. The means for exciting the array are not shown.

To operate with two polarizations, or with circular polarization, it is necessary for the structure 60 to be invariant on rotation through 90'. This yields the grid structure shown in the figure.

Figure 8:
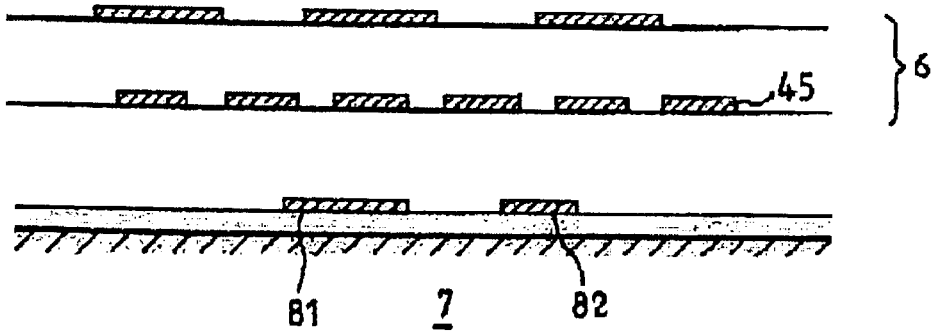
FIG. 8 shows another embodiment of a multisource antenna according to the invention.

Now consider multiband structures. FIG. 8 shows one embodiment of a multisource antenna according to the invention. For simplicity, the array 6 takes the form of a single resonant interface at each frequency. The antenna 7 includes two exciters 81, 82 operating at their respective natural frequencies. In the figure, the exciters are separate patches disposed side by side, but they can be slots. The exciter can equally be a dual band exciter, with one or two ports, for example a patch with a slot at its center, as shown in the FIG. 9 partial representation of one embodiment.

Figure 9:
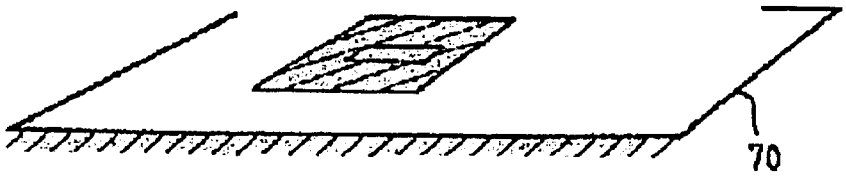
FIG. 9 shows part of a variant of FIG. 8.

A surface reflecting at the highest operating frequency $f_h$ and transparent at the lowest operating frequency $f_b$ is disposed at a distance of $\lambda_{fh}/2$ from the ground plane. A second surface reflecting at the frequency $f_b$ and transparent at the frequency $f_h$ is disposed at a distance of $\lambda_{fb}/2$ from the ground plane. In FIG. 9, the highest frequency reflective interface is made up of smaller metal patterns 45.

It must be emphasized that interference can occur that is caused by the not totally transparent nature of the interfaces in the other operating band. In this case, the solutions proposed in U.S. Pat. No. 6,061,027 can advantageously be used:

slight modification of the pattern as a function of its lateral position, truncation of the patterns with the objective of repolarizing the wave, in the case of operation with circular polarization, as shown in FIG. 6 of U.S. Pat. No. 6,061,027.

Figure 10:
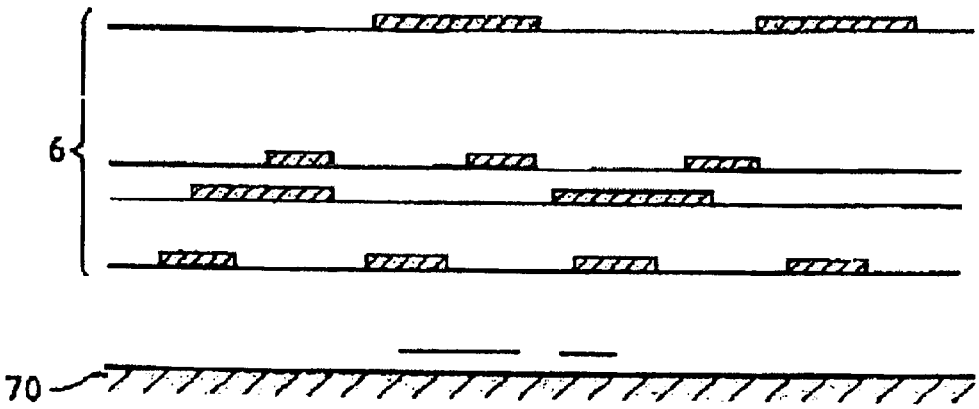
FIG. 10 shows another embodiment of a multisource antenna according to the invention.
Figure 12:
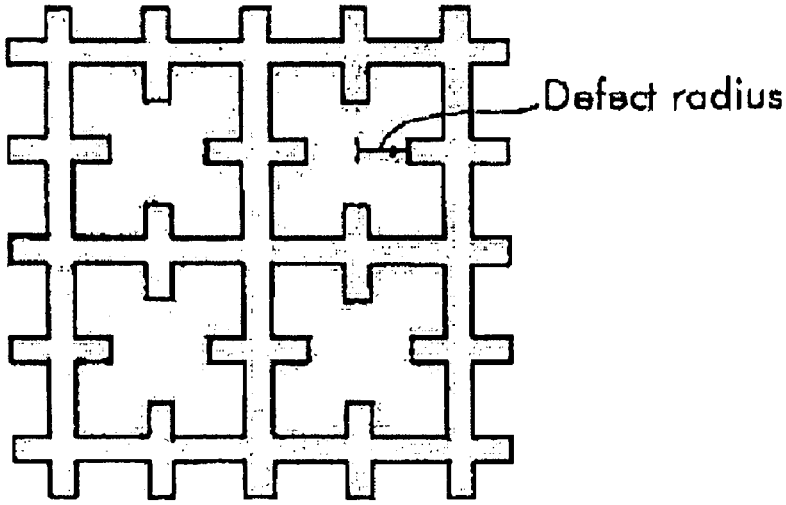
FIG. 12 shows the insertion of a defect into a metal crystal.

The distance between the patterns can be used to adjust the reflectivity of the interface. There may be a requirement for a lower reflectivity and for this to be compensated by a greater number of interfaces. In this case, multiband radiating elements are produced by interleaving different structures operating at each frequency, as shown in FIG. 10.

Consider now the method of obtaining a second pass-band that is independent of the first. If the periodicity of the crystal is disturbed, it is possible to create a selective pass-band within a forbidden band. The principle is similar to that of semiconductors.

The interference or the defect can be produced in metal wire structures by regularly removing a portion of the metal of the grid.

For multilayer structures, it can be achieved by locally modifying the thickness of a dielectric layer (or a rod in the case of 2D or 3D structures).

Consider now materials with resonating patterns.

These materials represent a special case, since the patterns also have characteristics that vary widely with frequency. Thus it is not only placing them in a periodic array that dictates the frequency response of these materials.

Until now structures with metal resonators have been described to explain how a second pass-band is added.

Figure 13:
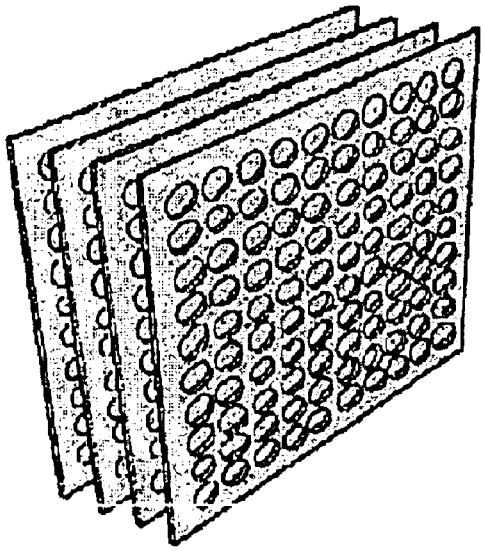
FIG. 13 shows a multiresonator structure with metallic resonators and slots.

Hereinafter, it is explained how the negatives of these structures are equally valid for the same function. They consist of regular perforations in the ground plane, as shown in FIG. 13.

Figure 14:
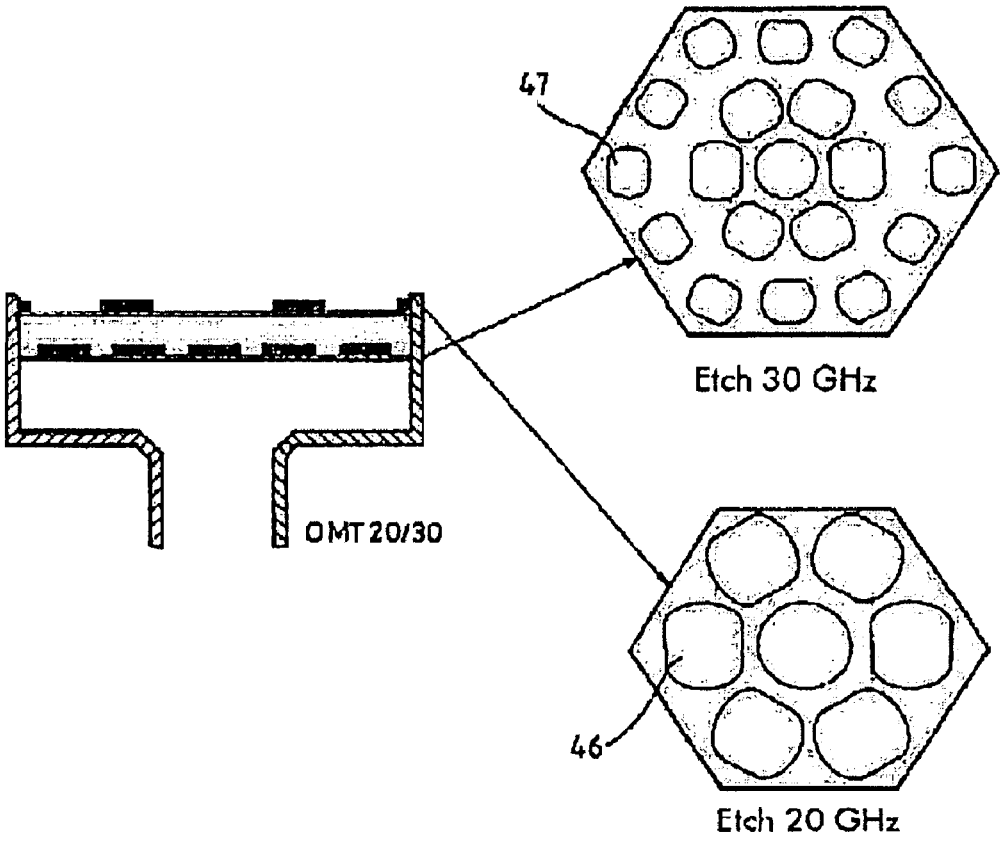
FIG. 14 represents a structure according to the invention with mixed arrangements.

Note also the possibility of mixed arrangements: a surface reflective at one frequency consisting of perforated patterns, and a reflective surface consisting of metal patterns, such as the radiating element operating in two separate bands shown in FIG. 14, including a multiresonator structure with metal resonators 47 and slots 46.

Accordingly, thanks to the invention as explained, a compact multisource antenna is obtained that does not necessitate more than one antenna at a time. The compactness is the result of using the inherent technology of plane antennas.

Of course, the invention is not limited to the embodiments described in the present application.

It will be noted that one of the sources can operate in a receive frequency band Rx and another of the sources can operate in a transmit frequency band Tx.

What is claimed is:

1. A multisource antenna including at least two excitation sources and spatial and frequency selective means for spatially channeling energy picked up/radiated by said excitation sources and providing for frequency decoupling between bands respectively corresponding to the waves received/transmitted by said sources, which are arranged on a ground plane to interleave radiating apertures at the level of said spatial and frequency selective means, wherein said spatial and frequency selective means comprise a forbidden photonic band array.

2. The antenna claimed in claim 1 wherein said forbidden photonic band array comprises an arrangement of dielectric plates with a one-dimensional period (1D arrangement).

3. The antenna claimed in claim 1 wherein said forbidden photonic band array comprises an arrangement of dielectric rods with a two-dimensional period (2D arrangement).

4. The antenna claimed in claim 1 wherein said forbidden photonic band array comprises an arrangement of dielectric rods with a three-dimensional period (3D arrangement, woodpile type).

5. The antenna claimed in claim 1 wherein the forbidden photonic band array comprises a periodic arrangement of metal patterns.

6. The antenna claimed in claim 1 wherein said forbidden photonic band array comprises a periodic arrangement of slots in said ground plane.

7. The antenna claimed in claim 1 wherein said forbidden photonic band array comprises an arrangement of metal wires.

8. The antenna claimed in claim 1 wherein said excitation sources form a passive focal array, the interleaving of the radiating apertures associated with each source of said passive focal array generating an energy channel radiated over an enlarged apparent surface area at the level of the forbidden photonic band array.

9. The antenna claimed in claim 1 wherein said excitation sources operate in different frequency bands and with a same radiating aperture.

10. The antenna claimed in claim 1 wherein said excitation sources operate in different frequency bands and with a same radiating aperture and said forbidden photonic band array comprises at least two metal plates with resonating patterns resonating at their natural frequency and transparent at the other resonant frequency.

11. The antenna claimed in claim 1 wherein said forbidden photonic band array comprises a periodic arrangement of metal wires, some of which wires are locally and periodically removed to form a second operating band independent of a first operating band.

12. The antenna claimed in claim 10, wherein one metal plate forms a reflective surface at a highest operating frequency and is transparent at a lowest operating frequency, being at a distance of $\lambda_{fh}/2$ ground plane, and a second metal plate forms a surface reflective at said lowest frequency and transparent at said highest frequency, being at a distance of $\lambda_{fh}/2$ from said ground plane.

13. The antenna claimed in claim 1, wherein said forbidden photonic band array comprises a periodic arrangement of dielectric plates, the thickness of one of which is modified relative to the others, this disruption of the period producing a second operating band independent of a first operating band.

14. The antenna claimed in claim 1, wherein at least one source operates in a receive frequency band and another source operates in a transmit frequency band.

15. The antenna claimed in claim 1, adapted to operate in a system with a reflector.

* * * * *

UNITED STATES PATENT AND TRADEMARK OFFICE
Certificate

Patent No. 6,927,729 B2 Patented: August 9, 2005

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Hervé Legay, Plaisance du Touch (FR); Marc Thevenot, Rilhac Rancon (FR); Bernard Jean-Louis Jecko, Rilhac Rancon (FR); Thierry Monediere, Limoges (FR); Regis Chantalat, Limoges (FR); Ludovic Leger, Lasserre (FR) and Patrick Dumon, Vigoulet-Auzil (FR).

Signed and Sealed this Twenty-second Day of April 2008.

DOUGLAS W. OWENS
*Supervisory Patent Examiner*
Art Unit 2821